US012507813B2

(12) United States Patent
DeRubes

(10) Patent No.: US 12,507,813 B2
(45) Date of Patent: Dec. 30, 2025

(54) SUSPENSION SUPPORT SYSTEM FOR JUMPERS

(71) Applicant: KIDS2, LLC, Atlanta, GA (US)

(72) Inventor: John D. DeRubes, Alpharetta, GA (US)

(73) Assignee: Kids2, LLC, Atlanta, GA (US)

( * ) Notice: Subject to any disclaimer, the term of this patent is extended or adjusted under 35 U.S.C. 154(b) by 24 days.

(21) Appl. No.: 18/454,669

(22) Filed: Aug. 23, 2023

(65) Prior Publication Data

US 2024/0065451 A1 Feb. 29, 2024

Related U.S. Application Data

(60) Provisional application No. 63/400,162, filed on Aug. 23, 2022.

(51) Int. Cl.
*A47D 13/10* (2006.01)

(52) U.S. Cl.
CPC ..... *A47D 13/107* (2013.01)

(58) Field of Classification Search
CPC ..... A47D 13/107; A47D 15/005
USPC ..... 297/274
See application file for complete search history.

(56) References Cited

U.S. PATENT DOCUMENTS 5,704,882 A * 1/1998 Coates ..... A47C 3/0252 297/274
2018/0070740 A1* 3/2018 Pomeroy ..... A47D 9/02
2019/0069692 A1* 3/2019 Healy ..... A47D 1/004

FOREIGN PATENT DOCUMENTS

DE 202020003879 U1 10/2020

OTHER PUBLICATIONS

International Search Report and Written Opinion dated Jan. 10, 2024 in co-pending PCT Patent Application No. PCT/US2023/072756.

* cited by examiner

*Primary Examiner* — Milton Nelson, Jr.
(74) *Attorney, Agent, or Firm* — Perilla Knox & Hildebrandt LLP; Bradley K. Groff; Stephanie L. Davy-Jow

(57) ABSTRACT

A combined suspension-safety support system and a children's jumper incorporated therewith. The combined suspension-safety support system comprises a primary suspension support system configured for suspending a child-receiving seat platform under normal operating conditions and a redundant secondary safety support system configured for engagement when the primary suspension support system fails.

19 Claims, 7 Drawing Sheets

SUSPENSION SUPPORT SYSTEM FOR JUMPERS

CROSS-REFERENCE TO RELATED APPLICATION

This application claims the benefit of U.S. Provisional Patent Application Ser. No. 63/400,162 filed Aug. 23, 2022, the entirety of which is hereby incorporated herein by reference for all purposes.

TECHNICAL FIELD

The present disclosure relates generally to the field of children support devices, and more particularly to children's activity centers and jumpers with improved safety support systems.

BACKGROUND

Jumpers and activity centers are used to entertain and promote development of a child's gross motor skills. Known jumpers generally include a seat suspended from a frame by restraints and/or straps such that the seat is configured to move relative to the frame and ground—typically in a vertical range of motion to simulate bouncing or jumping. However, these restraints and straps can fail from wear and tear, which can potentially lead to the seat unexpectedly falling during use. Accordingly, it can be seen that needs exist for an improved children's jumpers. It is to the provision of an improved children's jumper with an improved safety support system meeting these and other needs that the present disclosure is primarily directed.

SUMMARY

In example embodiments, the present disclosure relates to a children's jumper. The children's jumper includes a support frame, at least one support member, and a child-receiving apparatus. The support frame is configured for resting on a support surface or underlying floor and the at least one support mechanism is configured to suspend the child-receiving apparatus from the support frame such that the child-receiving apparatus is movable with respect to the support surface in a generally vertical direction.

In one aspect, the present disclosure relates to a children's jumper comprising a seat platform with a seat mounted thereto. The jumper further includes a support frame and at least one resilient support mechanism configured to suspend the seat platform from the support frame and allow movement of the seat platform relative to the support frame. The at least one resilient support mechanism comprises a primary, support member and a secondary, safety member. The primary, support member is load bearing under normal operating conditions and the secondary, safety member is configured to bear the load when the primary, support member fails. Optionally, the primary, support member and the secondary, safety member are both integrated into the support mechanism. Optionally, the primary, support member and the secondary, safety member are arranged or run in tandem. Optionally, the support mechanism comprises anchor points commonly shared by the primary, support and secondary, safety members. Optionally, the primary, support and secondary, safety members may be independently secured to the anchor points. Optionally, the support mechanism may further comprise a protective sleeve configured for managing any excess portions or material from the primary, support and secondary, safety members to prevent head entrapment between the primary, support and secondary, safety members.

In another aspect, the disclosure relates to a suspension-safety support system for a child activity apparatus such as for example a baby jumper or activity center. The suspension-safety support system is configured for suspending a child's seat or seat platform from a support frame of the baby jumper. The support system comprises a primary restraint and a secondary restraint at least partially enveloped in a protective sleeve for managing excess portions of the restraints. Preferably, the primary restraint is configured to bear the load of the child's seat in normal operating conditions and the secondary restraint is configured to bear the load when the primary restraint fails. Preferably, the primary and secondary restraints share common adjustable anchor points but are secured to the anchor points independently.

In example embodiment, the suspension-safety support system includes a primary support system having a first end and a second end opposite the first end, a secondary support system having a first end and a second end opposite the first end, a frame anchor bracket, and a platform anchor bracket. The first ends of the primary and secondary support systems are secured to the frame anchor bracket and the second ends of the primary and secondary support systems are secured to the platform anchor bracket. The primary support system comprises a first resilient member, a second resilient member, a third resilient member, and an elastic member, wherein the second resilient member and the elastic member extend between the first and second resilient members. The resilient members may be straps and the elastic member may be a spring.

Preferably, the primary and secondary support systems are secured to the anchor brackets independent from one another.

Optionally, the suspension-safety support system may include a sleeve, wherein the primary support system and/or the secondary support system are covered by the sleeve.

Optionally, the suspension-safety support system may further include a first sleeve and a second sleeve, wherein the primary support system is covered by the first sleeve and the secondary support system is covered by the second sleeve. Moreover, the first and second sleeve may be detachably secured to one another or the first and second sleeves may be permanently joined or secured to one another.

In another example embodiment, the suspension-safety support system includes a primary support system having a first end and a second end opposite the first end, a secondary support system having a first end and a second end opposite the first end; a protective sleeve; a frame anchor bracket; and a platform anchor bracket wherein the first ends of the primary and secondary support systems are secured to the frame anchor bracket and the second ends of the primary and secondary support systems are secured to the platform anchor bracket. The primary support system comprises a frame restraint portion, a spring restraint portion, a platform restraint portion, and a spring portion.

Preferably, the protective sleeve covers at least a portion of the primary support system. Optionally, the protective sleeve may cover at least a portion of the primary support system and a portion of the secondary support system. Alternatively, the protective sleeve may comprise a first sleeve section and a second sleeve section, wherein the first sleeve section covers at least a portion of the primary support system and the second sleeve section covers at least a portion of the secondary support system. Optionally, the first sleeve section and the second sleeve sections may be detachable from one another.

These and other aspects, features and advantages of the disclosure will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the disclosure, and are not restrictive of the disclosure, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Baby jumping entertainers, or jumpers, have been a mainstay in the baby industry. Known jumpers generally include a seat platform suspended from a frame by restraints and/or straps such that the seat platform is configured to move relative to the frame and ground—typically in a vertical range of motion to simulate bouncing or jumping. However, the seat platform and restraints wear down over time and use, which can lead to the seat platform unexpectedly falling during use or other critical failures.

Figure 1:
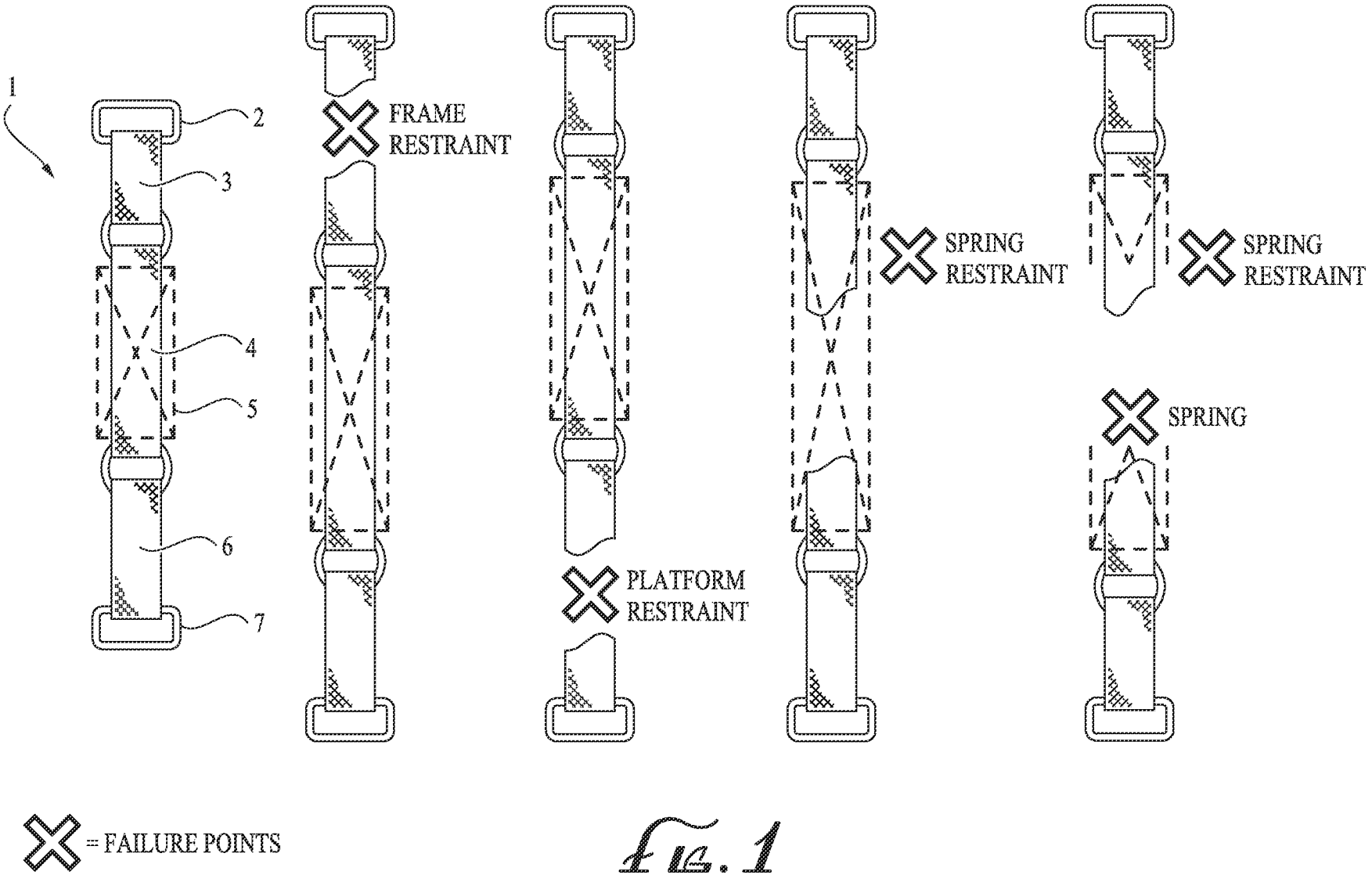
FIG. 1 PRIOR ART
FIG. 1 shows points of potential failure in the support straps or restraints of a jumper in the prior art, wherein the potential failures are represented by X.

With reference now to the drawing figures, wherein like reference numbers represent corresponding parts throughout the several views, FIG. 1 shows examples of points of potential failures (represented by X's) in the support straps and restraints 1 in the prior art. Generally, the support strap 1 includes a frame anchor 2 for coupling the support strap 1 to a support frame of for example a child jumper or activity center, a frame restraint 3, a spring restraint 4, a spring 5, a platform restraint 6, and a platform anchor 7 for coupling the support strap 1 to a seat platform of for example the child jumper or activity center. The spring restraint 4 and spring 5 are provided between the frame restraint 3 and platform restraint 6. Generally, the frame, spring, and platform restraints (3, 4, and 6) are made from resilient material.

As shown in FIG. 1, points of potential failures (e.g., a rip, disconnect, break, etc.) can occur along the frame restraint 3, the platform restraint 6, the spring restraint 4, or any combination thereof. Any of these failures can lead to injuries to the child supported by the support straps. For example, the spring restraint 4 is resilient and limits the motion/stretch of the spring 6 while providing a secondary safety support in case the spring 6 breaks or fails. However, if at least one of the other restraints (e.g., the platform restraint 5 and frame restraint 3) fail, then the seat holding the child can potentially drop to the floor causing injuries to the child. While still possible, the chances of both the spring restraint 4 and the spring 6 failing at the same time is less likely.

Figure 2B:
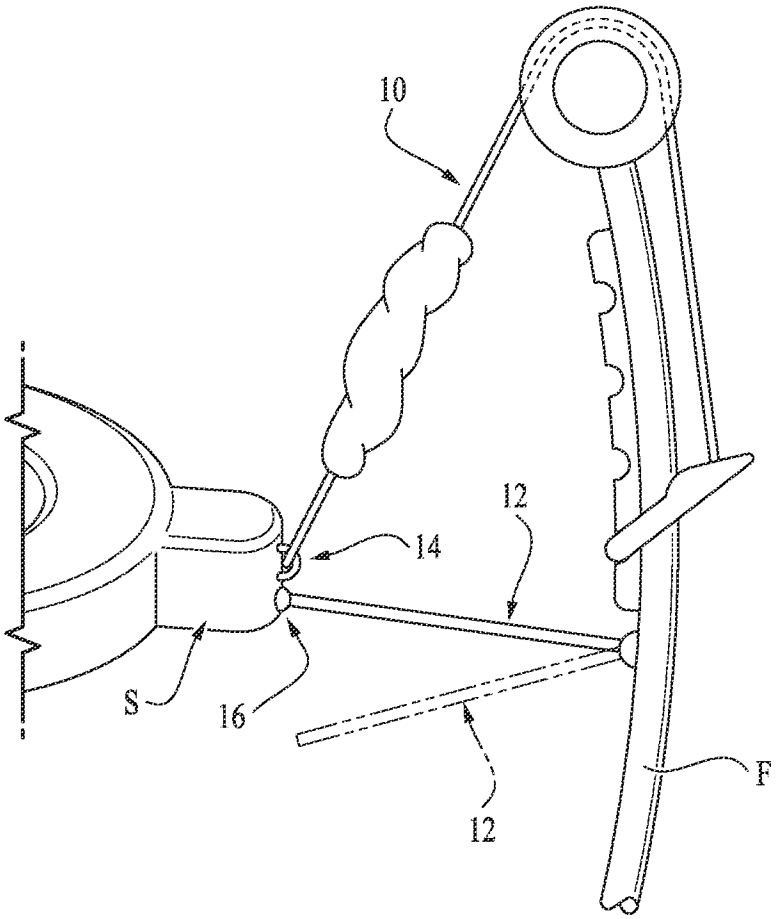
FIG. 2B PRIOR ART
FIGS. 2A-4 show functional limitations and safety concerns of incorporating separate attachment/anchor points for the primary support strap and the secondary safety strap.
Figure 2A:
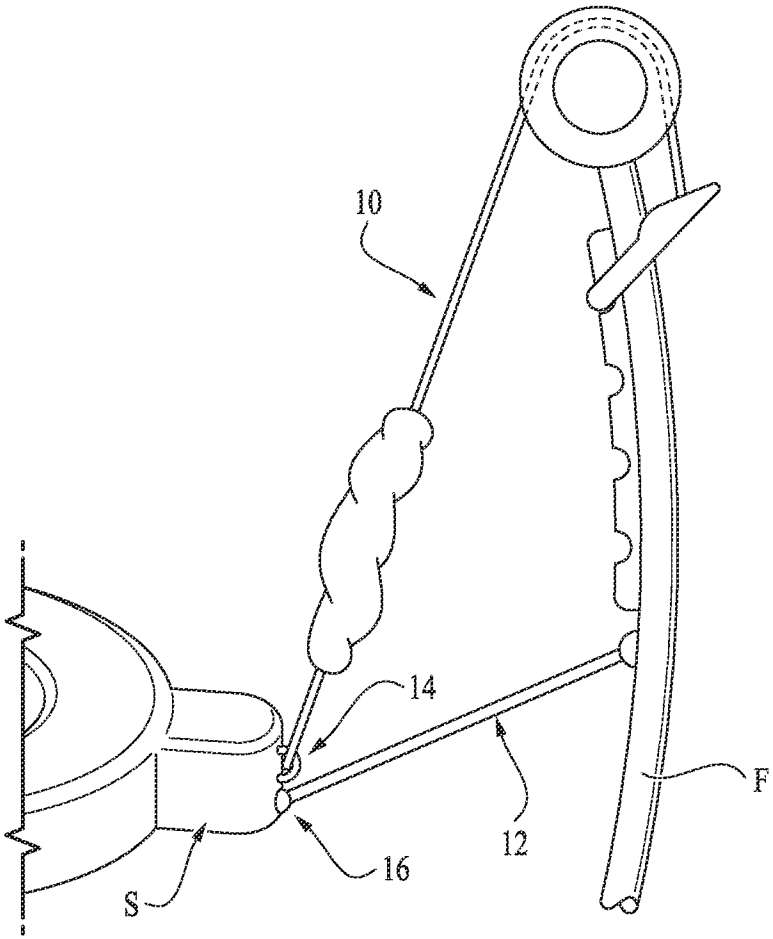
FIG. 2A PRIOR ART
Figure 3:
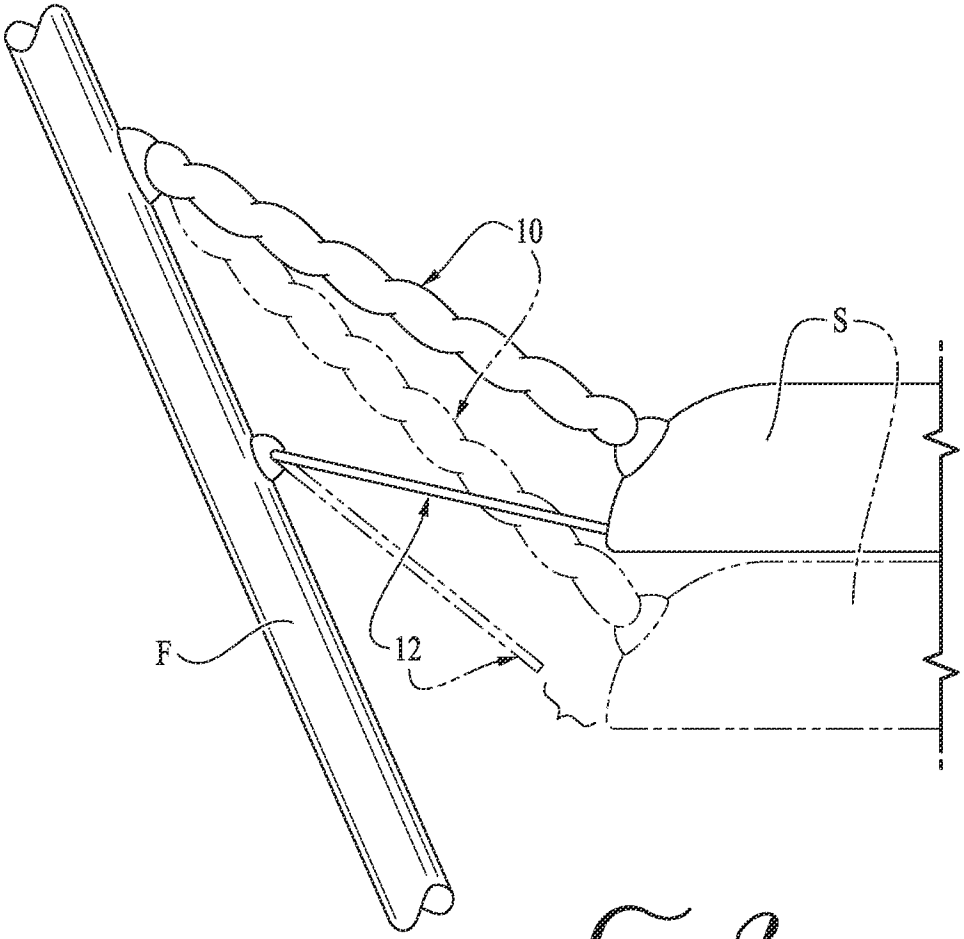
FIG. 3 PRIOR ART
Figure 4:
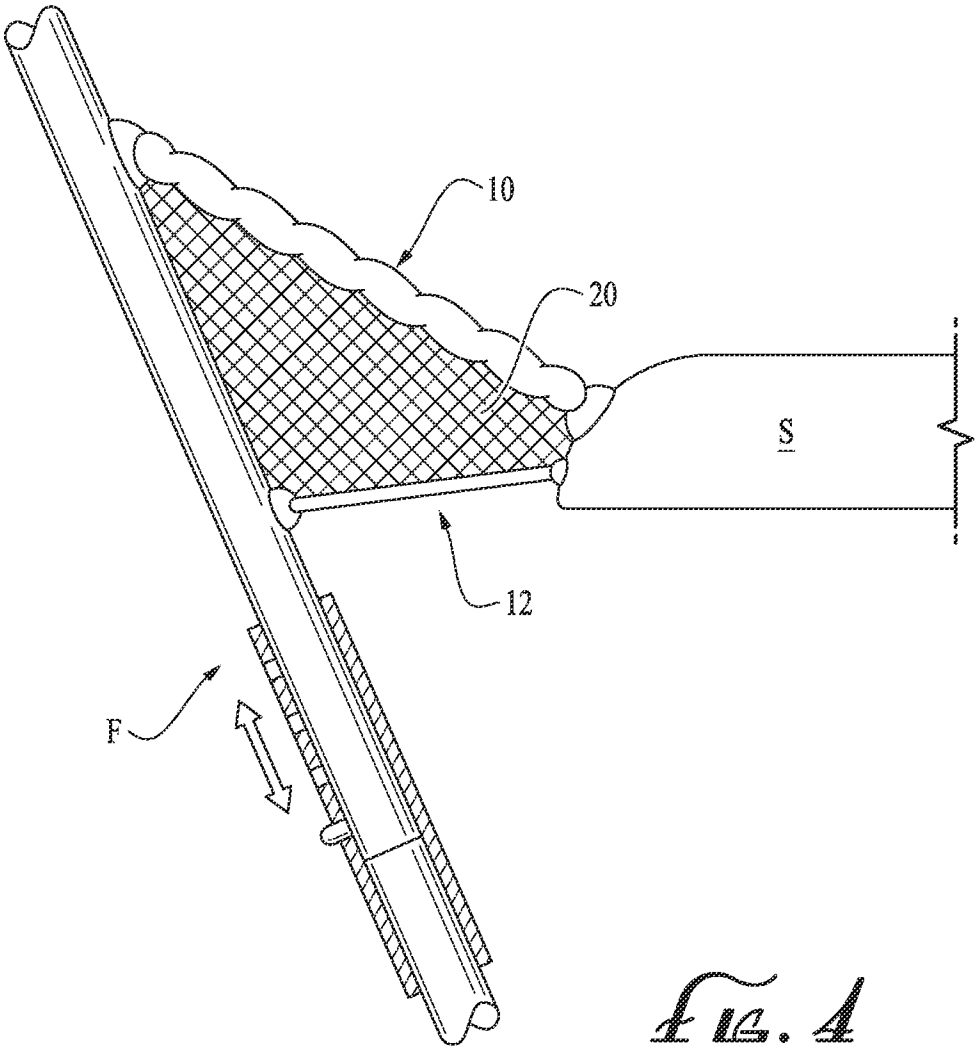
FIG. 4 PRIOR ART

There are several potential design options that can be implemented to address these failures, such as for example, improving the strength of the materials, utilizing more abrasion-resistant material to extend the life of the components, or adding a redundant system to the support straps. The most reliable approach is to add redundancy with the addition of a secondary support member. However, as shown in FIGS. 2A-4, there can be significant complications and design restrictions with the incorporation of a secondary support member with independent anchor points from the primary support member. For example, FIGS. 2A-2B show an arrangement where the primary support system 10 and the secondary safety strap 12 are attached to separate attachment or anchor points 14 and 16, respectively, on the seat platform S and jumper support frame F independent of one another. Such arrangement leads to the loss of functionality as the user tries to adjust the primary support straps to a lower position and the jumper no longer allows jumping. Moreover, incorporating independent primary and secondary suspension systems do not allow for any integral height adjustment as these adjustments would need to be independent of each other, which is not reasonable for the user to adjust correctly (see FIG. 3). This adjustment also causes a head entrapment issue between the primary support system/strap 10 and the secondary support system/strap 12. To allow for jumping capability and allow the seat to be adjusted by the straps (as opposed to by portions of the support frame), both support systems need to be adjusted simultaneously, which may limit the design. Building the height adjustment into the frame (e.g., by moving the legs or adjusting the frame as seen in FIG. 4) or incorporating a soft-goods material 20 to prevent head entrapment are also design restrictive and do not meet with modern demands of consumers.

The present disclosure is directed to suspension support systems for baby jumpers, and jumpers incorporated therewith, addressing the noted failures and other complications. For example, FIGS. 5A-9 show combined suspension-safety support systems according to example embodiments of the present disclosure. In example embodiments, the combined suspension-safety support system 100 generally comprises a primary support system 110 and a secondary support system 130 that runs or is arranged in tandem to the primary support system. According to example embodiments, the primary support system 110 functions primarily as the load-bearing suspension system under normal operations or conditions, whereas the secondary support system 130 functions primarily as the redundant or safety support system under failed operation or condition (i.e., when the primary support system breaks or fails). The primary and secondary support systems may comprise one or more connectors, buckles, couplers, clips, fasteners, springs, restraints and/or straps.

Figure 5A:
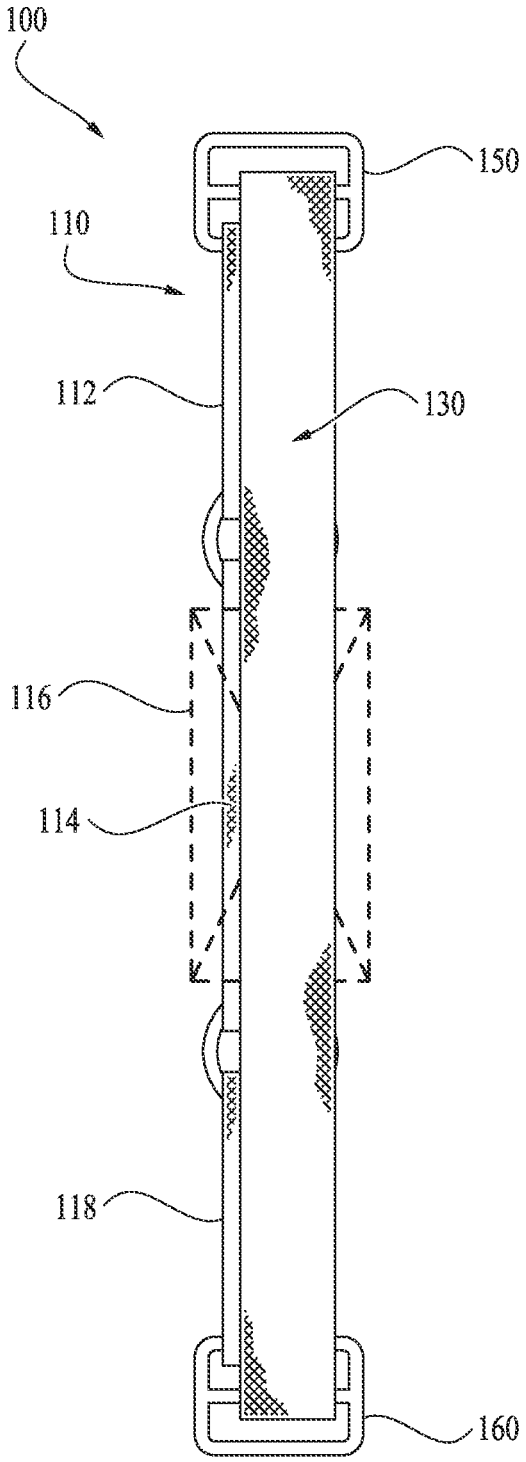
FIG. 5A shows a combined suspension-safety support system according to an example embodiment of the present disclosure.
Figure 5B:
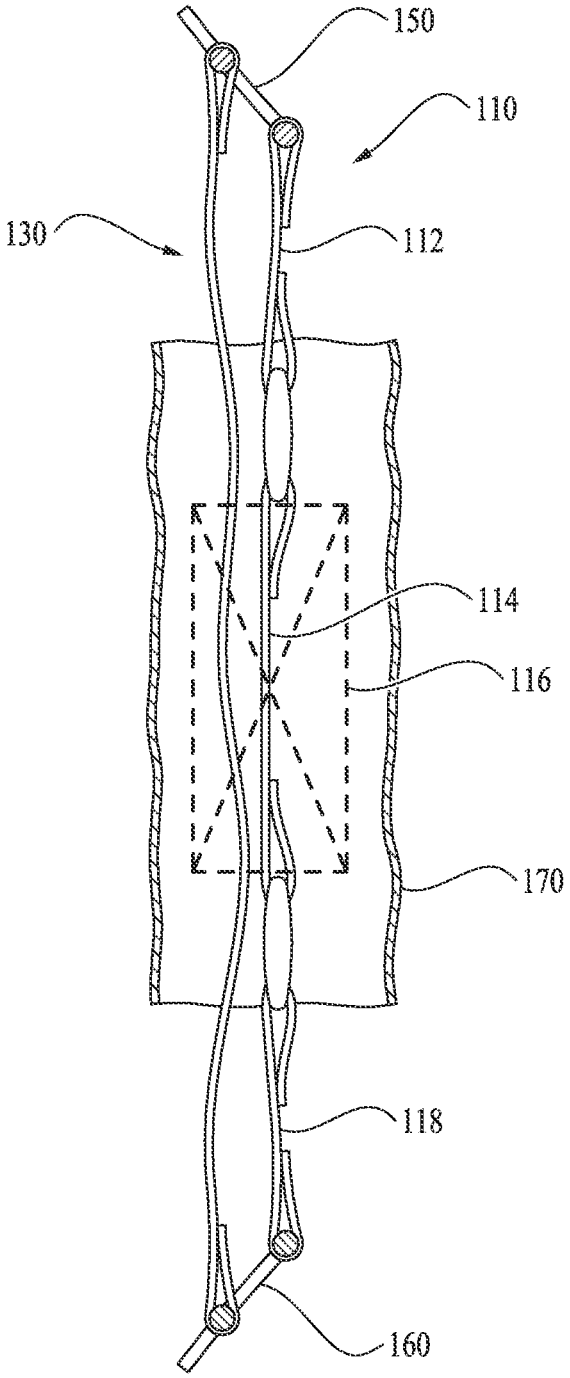
FIG. 5B is a side view of the combined suspension-safety support system of FIG. 6A.
Figure 6:
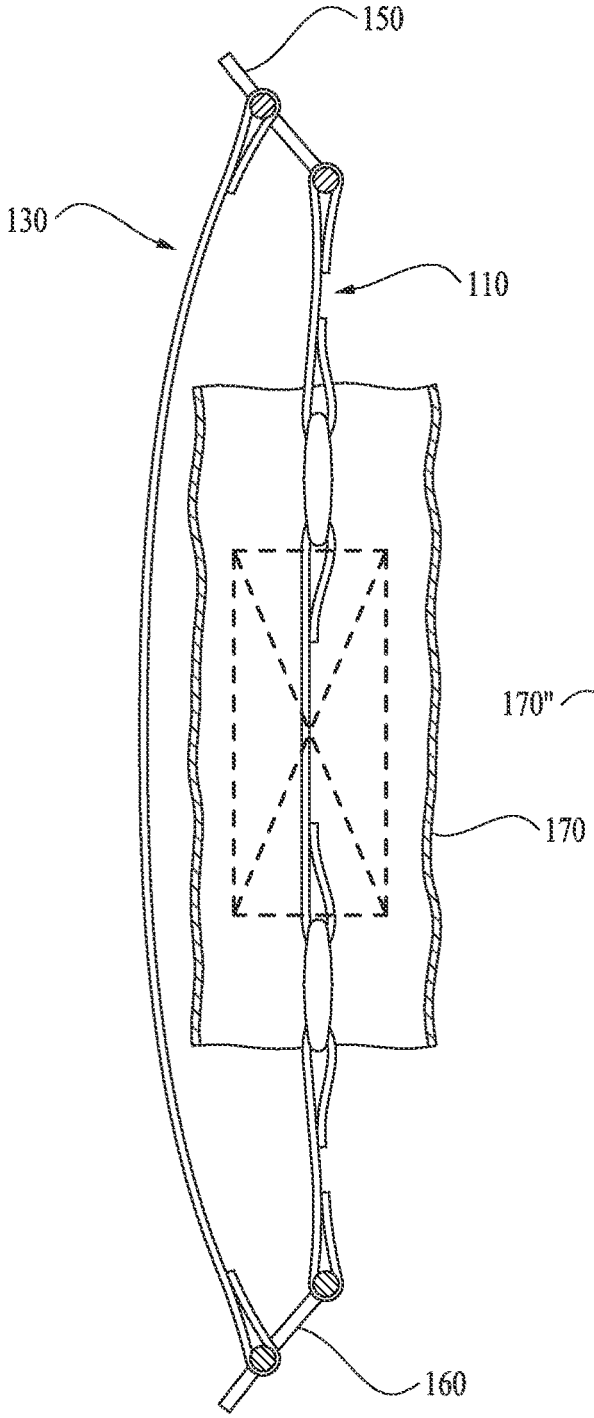
FIG. 6 is a side view of a combined suspension-safety support system according to another example embodiment of the present disclosure.
Figure 7:
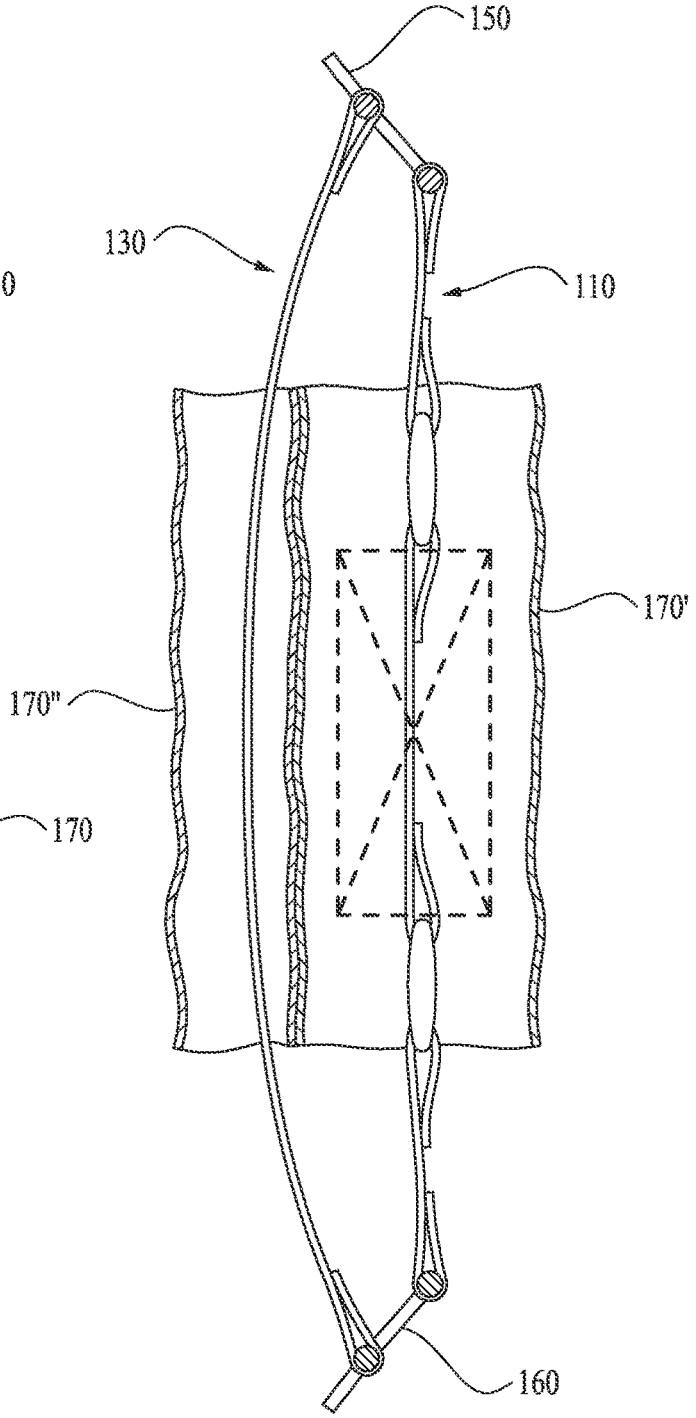
FIG. 7 is a side view of a combined suspension-safety support system according to yet another example embodiment of the present disclosure.
Figure 9:
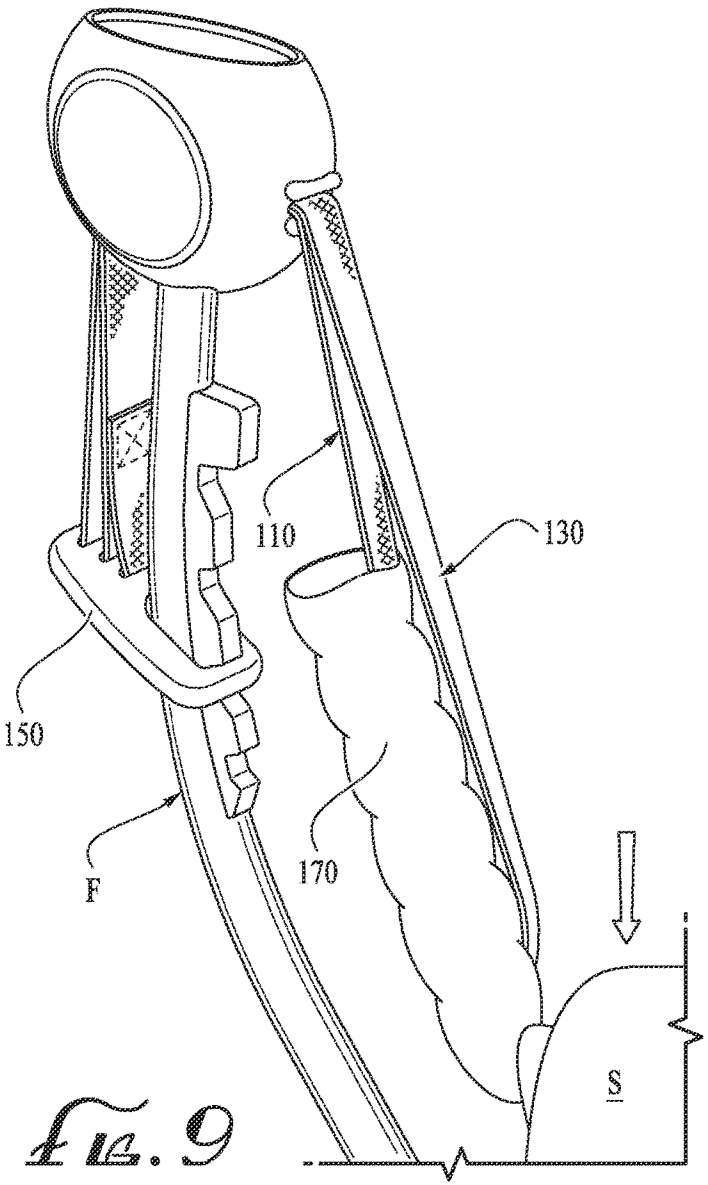
FIG. 9 shows the combined support system in a flexed or stretched state when maximum load is placed on the primary support system.
Figure 8:
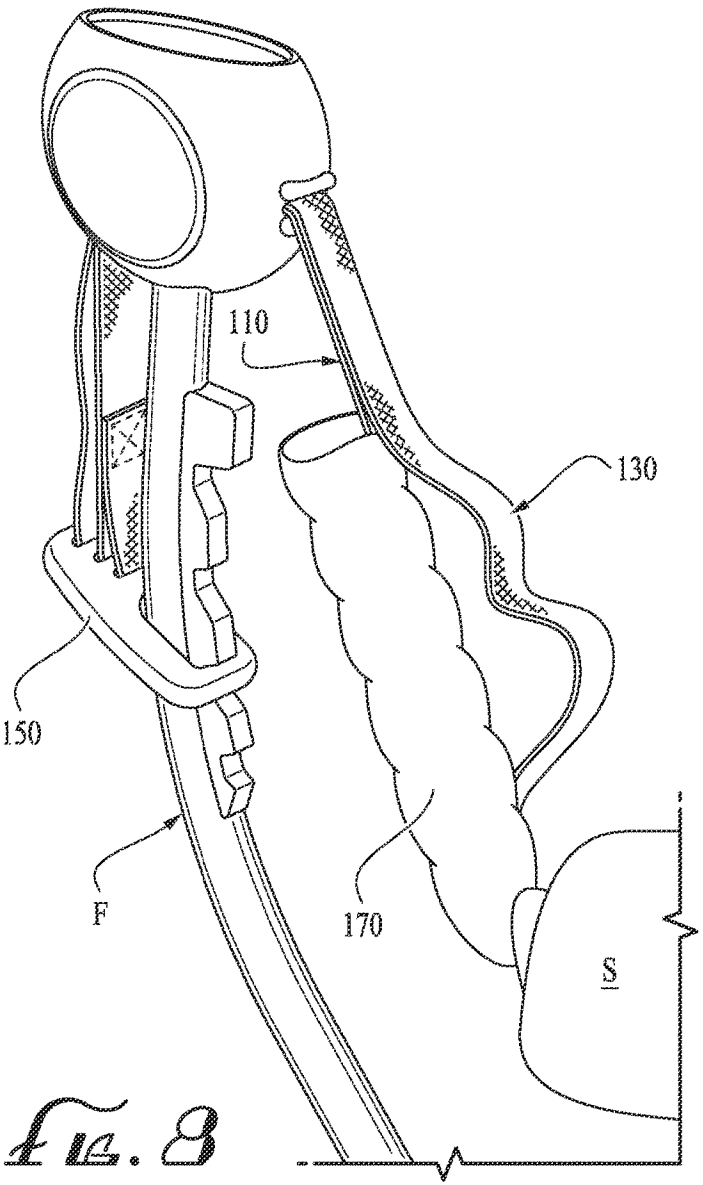
FIG. 8 shows the combined suspension-safety support system of FIG. 6 in a neutral or normal-operation state when less than maximum load is placed on the primary support system.

Combining or incorporating the primary and secondary support systems together makes the secondary support system seamless within the overall design and function of the combined suspension support system. This is accomplished by incorporating a secondary support system that runs in tandem with the primary support system. For example, as shown in FIG. 5, the combination suspension-safety support system 100 comprises a primary support system 110, the primary support system comprising a frame restraint 112, a spring restraint 114, a spring or elastic member 116, and a platform restraint 118, and a second support system 130 comprising a safety strap 132. The primary and secondary support systems are connected to a frame anchor or bracket 150 and a platform anchor or bracket 160 but the primary and secondary support systems are independently connected to the anchors (i.e., the primary and secondary support systems are not directly connected or secured to one another). As shown in FIGS. 5-7, the integrated support system may also comprise a protective spring sleeve or cover 170, which can be incorporated in different ways to manage any excess material or portions of the primary and secondary support systems to help prevent head entrapment between the primary and secondary restraints.

According to example embodiments, the secondary strap 132 is fastened in a non-load bearing fashion such that when the primary system is fully loaded, there is no significant load on the secondary system (i.e., normal operation or condition). The secondary restraint system 130 is engaged when there is a failure at any point along the resilient primary support system 110 (i.e., failed operation or condition). Moreover, the integrated or combined support system allows for a seamless height adjustment feature as the primary and secondary support systems are tied to a common adjustable anchor point on the jumper support frame and/or seat platform. In example embodiments, the anchor points 150 and 160 are rigid members configured for connecting the resilient members (i.e., the support system or support straps 110, 130) to the jumper support frame or structure and/or the seat platform. As shown in FIG. 5, both the primary and second support systems 110, 130 extend between and are secured to the frame anchor 150 and platform anchor 160. The anchor points can be made from metal, plastic, or other types of non-flexible material resistant to wear, abrasion, and fractures.

In example embodiments, the resilient members, such as for example the primary and secondary support systems comprise flexible members made from woven or braided flexible material (such as for example nylon or polyester webbing, fabric, rope, or cable). Preferably, the secondary support system is completely independent from the primary suspension system in that the failure of the primary suspension system does not affect the function or operation of the secondary support system. Preferably, if or when the primary support system fails (i.e., failed operating condition), the secondary support system is configured to fully support the weight or load of the seat platform and its occupant (i.e., child or infant) and prevent the seat platform from falling to the ground or support surface. Preferably, the secondary support system is configured to prevent the seat or seat platform from tilting no more than 25° from the horizontal should the primary suspension systems fail and prevent other hazardous conditions.

According to one example embodiment, the secondary support system 130 is threaded through the spring assembly 116 and tacked to the spring sleeve 170 and the secondary support system 130 is not under any load, as shown in FIG. 5. In another example embodiment, the secondary support system 130 is located or arranged outside of the spring sleeve 170, as shown in FIG. 6. In yet another example embodiment, the primary support system 110 is threaded through or covered by a first spring sleeve 170' and the secondary support system 130 is threaded through or covered by a second spring sleeve 170" separate from the first spring sleeve, as shown in FIG. 7. The first and second spring sleeves may be permanently attached to one another or the first and second spring sleeves 170' and 170" may comprise means for detachably securing one to the other. For example, the spring sleeves may comprise cooperative hook-and-loop fasteners, clips, buttons, or other suitable connecting mechanisms for detachably securing them together.

While the invention has been described with reference to example embodiments, it will be understood by those skilled in the art that a variety of modifications, additions and deletions are within the scope of the invention, as defined by the following claims.

What is claimed is:

1. A baby jumper comprising:

a support frame;

a seat platform configured for receiving a child therein; and one or more suspension support system configured for suspending the seat platform from the support frame such that the seat platform is moveable relative to the support frame, wherein the one or more suspension support systems comprise a primary support member and a secondary support member, wherein the primary support member comprises a support strap and the secondary support member comprises a safety strap, wherein the safety strap is non-load bearing under normal operation and load bearing under failed operation.

2. The baby jumper of claim 1, wherein the primary support member comprises at least one buckle, spring, restraint or an additional strap.

3. The baby jumper of claim 1, where in the primary support member and the secondary support member are connected by one or more anchors.

4. The baby jumper of claim 1, wherein the primary support member is configured for engagement under normal operating conditions and the secondary support member is configured for engagement under failed operating conditions when the primary support member fails.

5. The baby jumper of claim 1, further comprising a first sleeve and a second sleeve, wherein the primary support system is covered by the first sleeve and the secondary support system is covered by the second sleeve.

6. The baby jumper of claim 5, wherein the first and second sleeve are detachably secured to one another.

7. The baby jumper of claim 5, wherein the first and second sleeve are permanently secured to one another.

8. The baby jumper of claim 1, wherein the primary support system comprises a first resilient member, a second resilient member, a third resilient member, and an elastic member, wherein the second resilient member and the elastic member extend between the first and third resilient members.

9. The baby jumper of claim 8, wherein the resilient members are straps and the elastic member is a spring.

10. The baby jumper of claim 1, wherein the primary support member and the secondary support member are secured to anchor brackets independent from one another.

11. A baby jumper comprising:

a support frame;

a seat platform configured for receiving a child therein; and one or more suspension support system configured for suspending the seat platform from the support frame such that the seat platform is moveable relative to the support frame, wherein the one or more suspension support systems comprise a primary support member and a secondary support member, wherein the secondary support member comprises a safety strap, and wherein the primary support system comprises a first resilient member, a second resilient member, a third resilient member, and an elastic member, wherein the second resilient member and the elastic member extend between the first and third resilient members.

12. The baby jumper of claim 11, wherein the primary support member comprises at least one buckle, spring, restraint or an additional strap.

13. The baby jumper of claim 11, where in the primary support member and the secondary support member are connected by one or more anchors.

14. The baby jumper of claim 11, wherein the primary support member is configured for engagement under normal operating conditions and the secondary support member is configured for engagement under failed operating conditions when the primary support member fails.

15. The baby jumper of claim 11, further comprising a first sleeve and a second sleeve, wherein the primary support system is covered by the first sleeve and the secondary support system is covered by the second sleeve.

16. The baby jumper of claim 15, wherein the first and second sleeve are detachably secured to one another.

17. The baby jumper of claim 15, wherein the first and second sleeve are permanently secured to one another.

18. The baby jumper of claim 11, wherein the resilient members are straps and the elastic member is a spring.

19. The baby jumper of claim 11, wherein the primary support member and secondary support member are secured to anchor brackets independent from one another.

* * * * *